US006076319A

United States Patent [19]

Hendershot et al.

[11] Patent Number: 6,076,319

[45] Date of Patent: Jun. 20, 2000

[54] PRECAST CONCRETE CONSTRUCTION AND CONSTRUCTION METHOD

[76] Inventors: Gary L. Hendershot, 3303 Grange Hall Rd., Holly, Mich. 48442; Gregory E. Cook, 1637 Scenic Hollow, Rochester Hills, Mich. 48306

[21] Appl. No.: 09/007,672

[22] Filed: Jan. 15, 1998

Related U.S. Application Data

[62] Division of application No. 08/539,013, Oct. 3, 1995, Pat. No. 5,761,862.

[51] Int. Cl.[7] ..... E04B 1/38; E04B 7/20; E04B 5/00; E04B 2/00

[52] U.S. Cl. ..... 52/271; 52/79.9; 52/91.1; 52/94; 52/270; 52/284; 52/295; 52/583.1; 52/586.1; 52/586.2; 52/587.1; 52/590.2; 52/592.1; 52/234

[58] Field of Search ..... 52/270, 271, 284, 52/294, 295, 432, 583.1, 586.1, 586.2, 587.1, 589.1, 590.1, 590.2, 592.1, 604, 92.1, 79.9, 79.14, 91.1, 94, 234

[56] References Cited

U.S. PATENT DOCUMENTS

| | | | |
|---|---|---|---|
| 1,155,038 | 9/1915 | Broughton . | |
| 1,479,557 | 1/1924 | Raymond | 52/91.1 |
| 1,558,801 | 10/1925 | Frey | 52/583.1 |
| 1,618,886 | 2/1927 | Peterson | 52/295 X |
| 1,726,169 | 8/1929 | Winter . | |
| 1,924,801 | 8/1933 | Olmstead . | |
| 2,091,061 | 8/1937 | Waugh | 52/94 X |
| 2,103,894 | 12/1937 | Bussman | 52/586.1 |
| 2,144,630 | 1/1939 | Kotrbaty | 52/586.1 X |
| 2,652,713 | 9/1953 | Senglar | 52/583.1 |
| 2,810,287 | 10/1957 | Anderson | 52/432 |
| 3,076,286 | 2/1963 | Czecholinski . | |
| 3,126,671 | 3/1964 | Nagel | 52/583.1 X |
| 3,394,522 | 7/1968 | Maurer | 52/583.1 |
| 3,685,241 | 8/1972 | Cooper . | |
| 3,759,002 | 9/1973 | Cornella et al. | 52/270 |
| 3,803,788 | 4/1974 | Artmann | 52/583.1 X |
| 3,818,660 | 6/1974 | Dillon . | |
| 3,832,817 | 9/1974 | Martens | 52/583.1 |
| 3,898,776 | 8/1975 | Cox et al. . | |
| 3,919,812 | 11/1975 | Van der Lely et al. . | |
| 4,115,980 | 9/1978 | Martel et al. . | |
| 4,324,081 | 4/1982 | Chicha | 52/587.1 X |
| 4,569,167 | 2/1986 | Staples . | |
| 4,750,306 | 6/1988 | Granieri . | |
| 4,811,536 | 3/1989 | Hardt | 52/295 X |
| 5,072,554 | 12/1991 | Hayman . | |
| 5,131,201 | 7/1992 | Larson et al. . | |
| 5,758,461 | 6/1998 | McManus | 52/271 X |
| 5,761,862 | 6/1998 | Hendershot et al. | 52/271 |

FOREIGN PATENT DOCUMENTS

| | | | |
|---|---|---|---|
| 889320 | 1/1944 | France | 52/586.2 |
| 1200506 | 9/1965 | Germany | 52/583.1 |
| 613647 | 12/1960 | Italy | 52/587.1 |
| 168960 | 7/1934 | Switzerland | 52/583.1 |
| 167005 | 4/1959 | Switzerland | 52/583.1 |
| 634877 | 3/1950 | United Kingdom | 52/583.1 |
| 1020180 | 2/1966 | United Kingdom | 52/583.1 |

*Primary Examiner*—Robert Canfield

*Attorney, Agent, or Firm*—Reising, Ethington, Barnes, Kisselle, Learman & McCulloch P.C.

[57] ABSTRACT

The building system employs precast corners (16) and elongated walls (12) with integral footings (14 and 18) to construct a foundation and basement. Precast first elongated wall sections (50) and corner sections (52) and floor slabs form a first level. Upper level wall sections (74), corner sections (76) and floor slabs (72) form an upper level. Gable sections (90), a ridge beam (92) and roof slabs (94) form a roof. The precast members all include a steel mesh reinforcement (102, 104 and 106). Sections are rigidly connected together at their ends (58 and 68) by connector assemblies (108 and 160) that are connected directly to the reinforcement (102). The sections are secured together by sheebolts (120) that extend vertically from a lower section into an upper section.

12 Claims, 6 Drawing Sheets

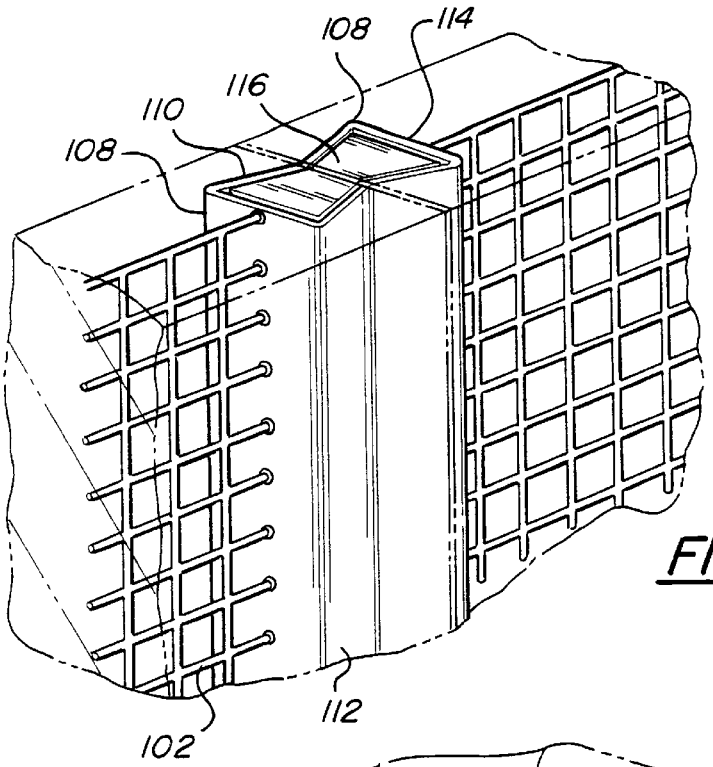
FIG-2
FIG-3
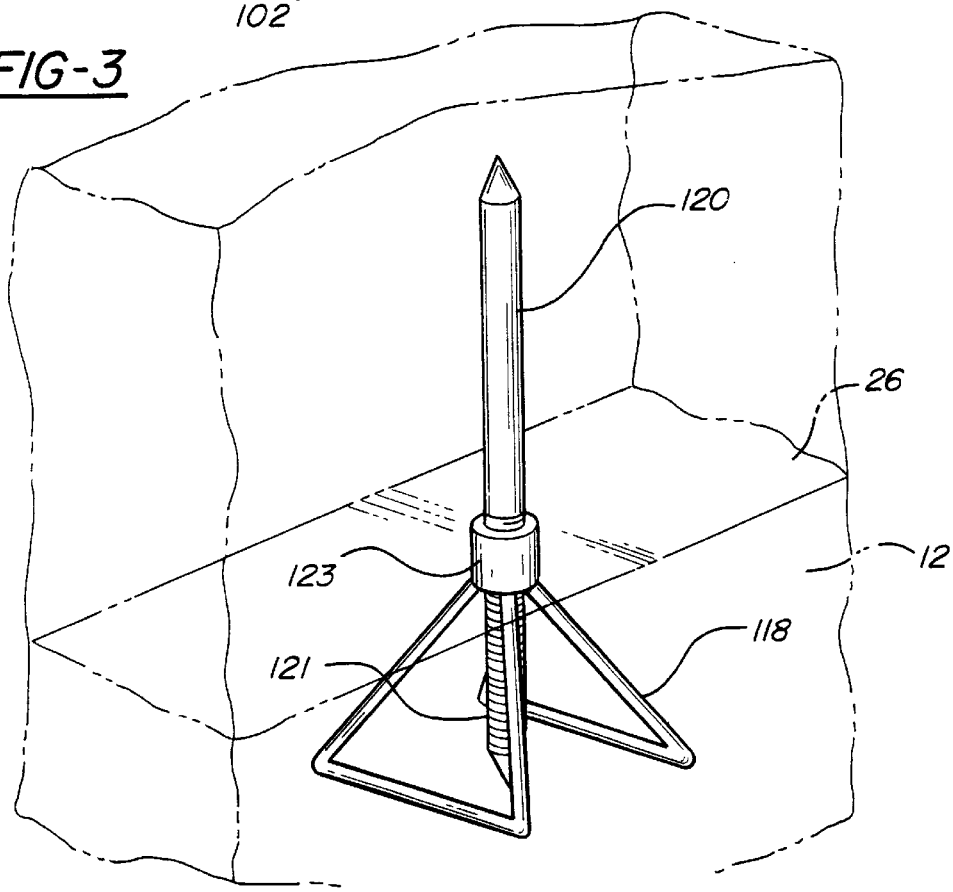

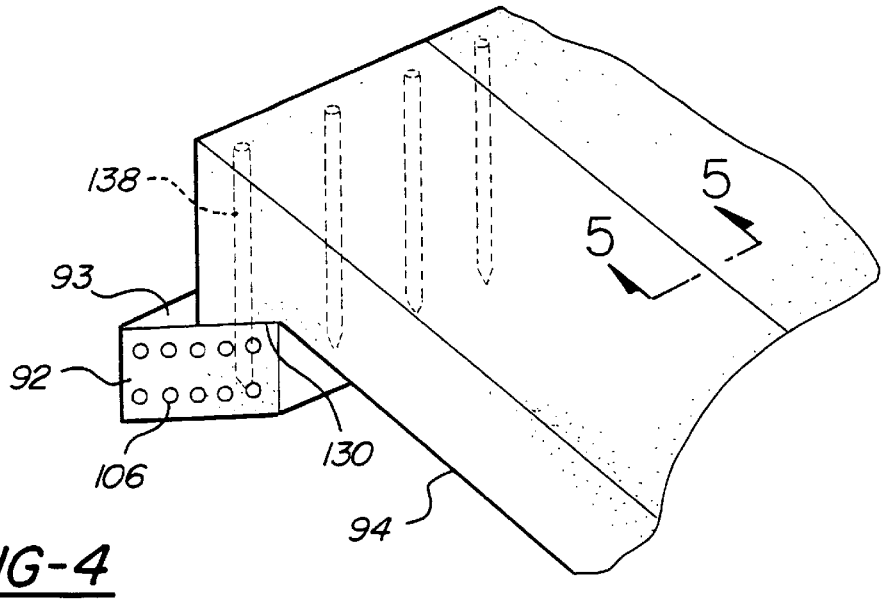
FIG-4
FIG-5
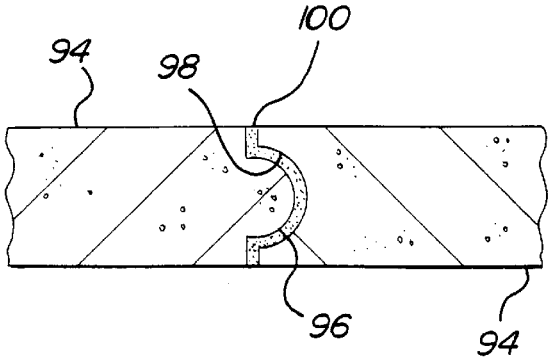
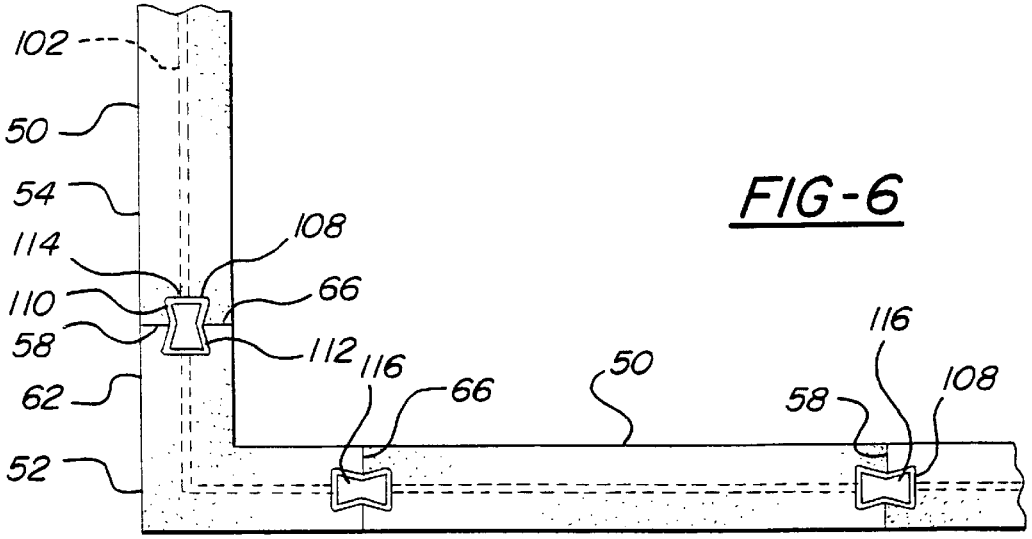
FIG-6

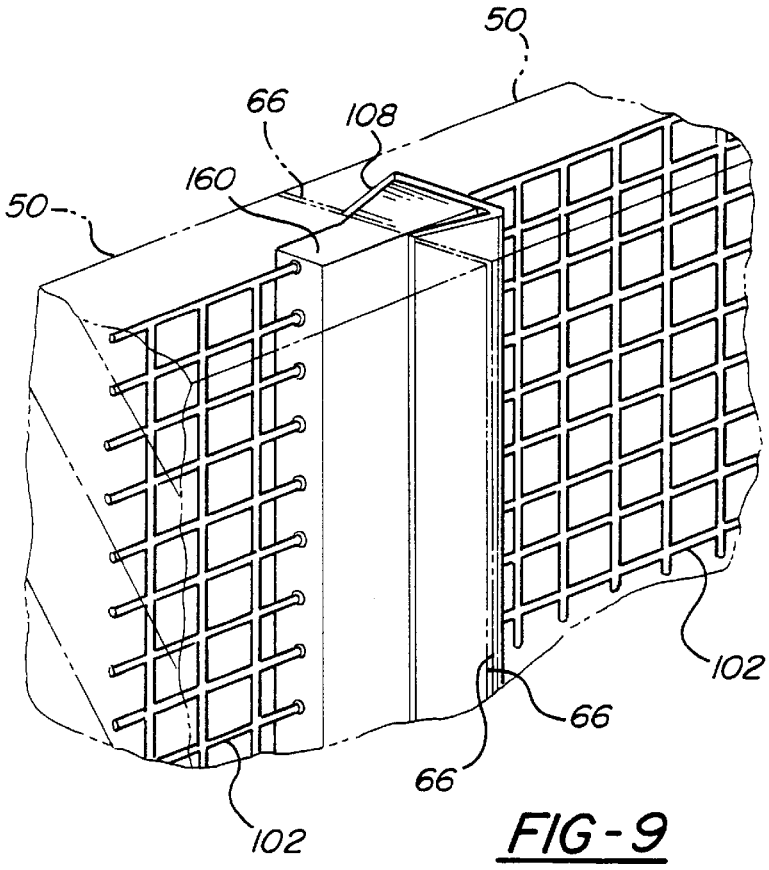
FIG-9
FIG-10
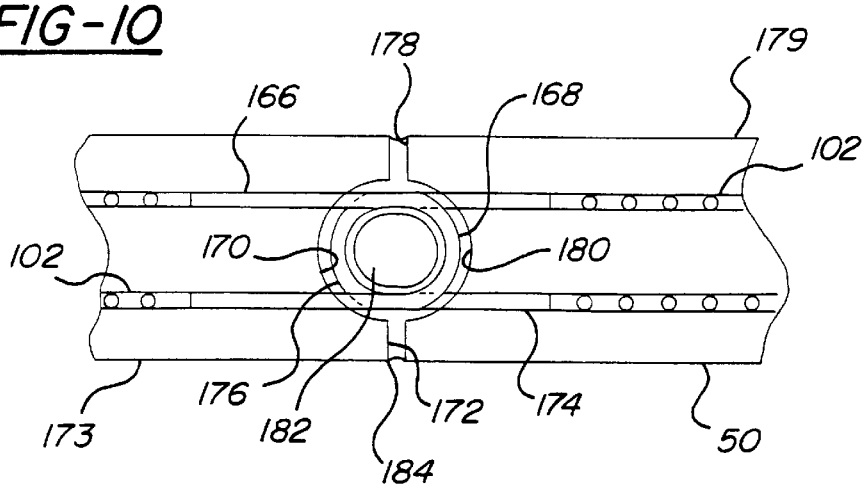

PRECAST CONCRETE CONSTRUCTION AND CONSTRUCTION METHOD

This is a divisional application of Ser. No. 08/539,013 filed on Oct. 3, 1995 now U.S. Pat. No. 5,761,862.

This invention relates to construction of buildings and civil engineering works and a method of construction and, more particularly, to buildings and civil engineering works constructed of preformed concrete sections.

BACKGROUND OP THE INVENTION

Buildings and civil engineering works are generally constructed from wood, metal, masonry, concrete and combinations of these materials. The materials used depend upon cost, availability, building conditions, structural requirements and choice. Masonry and concrete have generally required extensive on site construction. Wood and steel construction have been used to build buildings and building parts in a factory. The buildings and building parts are transported to and erected on a site. Reducing construction time on a building site can reduce construction costs.

Masonry and concrete construction are generally conducted almost entirely on a building site. Precast concrete construction, with parts made in a factory, has been used extensively for some civil engineering works. Such construction has not been used extensively for buildings.

Masonry and concrete construction are difficult on building sites in some weather conditions. During cold weather, on site masonry and concrete construction are generally impossible. In northern parts of the U.S. and Canada, there is little or no masonry or concrete construction for several months each year. On site construction can also be delayed by water and snow. These delays increase construction costs.

Concrete and masonry construction have a number of important advantages that wood construction does not have. Buildings made from concrete and masonry can withstand much higher wind loads than wood frame houses. Such buildings may also withstand earthquakes with less damage than frame houses. Concrete and masonry construction is also generally fire proof.

Building site contamination during construction is a problem. Forms, for foundations and concrete basement walls, are coated with materials that prevent concrete from sticking to the forms. Some of these coating materials remain on the site after the forms are removed. Coatings applied to concrete to prevent water absorption and water passage may also contaminate a building site. Concrete that is spilled, dumped or washed from tools, mixers and conveyor chutes often remain in the soil on a site following construction. Similar site contamination occurs during masonry construction.

SUMMARY OF THE INVENTION

An object of this invention is to provide precast concrete corner sections and elongated wall sections that can be transported to a building site and erected.

Another object of the invention is to provide precast concrete corner sections and elongated wall sections with integral footings that are transported to a building site for erection.

A further object of the invention is to provide a substantially complete building structure from the footings up that is precast.

A still further object of the invention is to provide a precast component building with the ability to withstand high winds, fires and moderate earthquakes.

A yet further object of the invention is to provide a building system that permits the erection of a building and civil engineering works in wet conditions, in below freezing temperatures, and when there is snow cover.

A yet still further object of the invention is to provide a building system that minimizes site contamination during construction and facilitates site clean up if a building or civil engineering work is removed.

Another yet further object of the invention is to provide precast concrete sections that can be used for building foundations, retaining walls, sea walls, flood control dikes and other similar uses.

Corner sections with integral footings and elongated wall sections with integral footings are precast and transported to a building site for erection. The integral footings are placed directly on a flat prepared surface or surfaces. The surface should be compacted and can be covered with an aggregate, if desired or required for drainage. The elongated wall sections and corner sections are locked together to hold them in vertical positions. The corner sections and elongated wall sections can also be locked together to prevent lateral, longitudinal and vertical separation. Precast basement floor slabs are positioned between the corner and elongated wall sections and above the integral footings. Floor slabs for the first floor are placed on a ledge near the top or on top of the corner sections and elongated wall sections with integral footings to form the first floor. Rod members are attached to the ledge or the top of the lower level wall and corner sections and extend into passages in the floor slabs to prevent horizontal movement of the floor slabs relative to the lower level wall and corner sections. First floor corner and elongated wall sections are then positioned on top of the floor slabs or on top of the lower level wall and corner sections to form the first floor. The rod members that extend up into the passages in the floor slabs extend through the floor slabs and into passages in the first floor corner and elongated wall sections. If the floor slabs for the first floor are placed on ledges as set forth above, the first floor corner and elongated wall sections are placed on top of the lower level wall and corner sections and rod members extending upward from the lower level wall and corner sections extend into passages in the first floor corner and elongated wall sections. Openings are provided in the first floor wall sections for doors and windows as required.

A second floor, if it is to be a two-story building, is formed by placing precast floor slabs on top of the first floor corner sections and wall sections or on top of a ledge near the top of the corner and wall sections. Second floor wall and corner sections are then placed on top of the floor slabs that form the second floor, or on top of the first floor corner and wall sections. Precast gable members are positioned on top of the wall sections and a precast ridge beam is placed on top of the gable members. Roof slabs are then placed on top of the ridge beam and the upper surface of the upper wall and corner sections. Joints between the sections and slabs are sealed as required. Generally vertical pins are provided as described above to prevent horizontal movement of the gables, the ridge beam, and the roof slabs.

Wall sections and corner sections, especially the sections with integral footings can be used for retaining walls, sea walls, flood control dikes and other similar uses. These precast units are especially useful where high strength and quick erection are desirable or required.

The foregoing and other objects, features, and advantages of the present invention will become apparent in the light of the following detailed description of an exemplary embodiment thereof, as illustrated in the accompanying drawings.

THE DRAWINGS

The presently preferred embodiment of the invention is disclosed in the following description and in the accompanying drawings, wherein:

FIG. 2 is an enlarged view of a connection structure employed between the vertical ends of two precast sections;

FIG. 3 is an enlarged view of a connection between the horizontal surfaces of two precast sections;

FIG. 4 is an enlarged perspective view showing the connection between a roof slab and the ridge beam;

FIG. 5 is an enlarged sectional view taken along line 5—5 in FIG. 4, showing the seal between two roof slabs;

FIG. 6 is a plan view showing the connection between the abutting end surfaces of a corner section and adjacent elongated wall sections;

FIG. 9 is an enlarged view of a high strength connection structure employed between the vertical ends of two precast sections;

FIG. 10 is a plan view showing an alternate connection between adjacent ends of elongated wall sections;

DESCRIPTION OF THE PREFERRED EMBODIMENT

Figure 1:
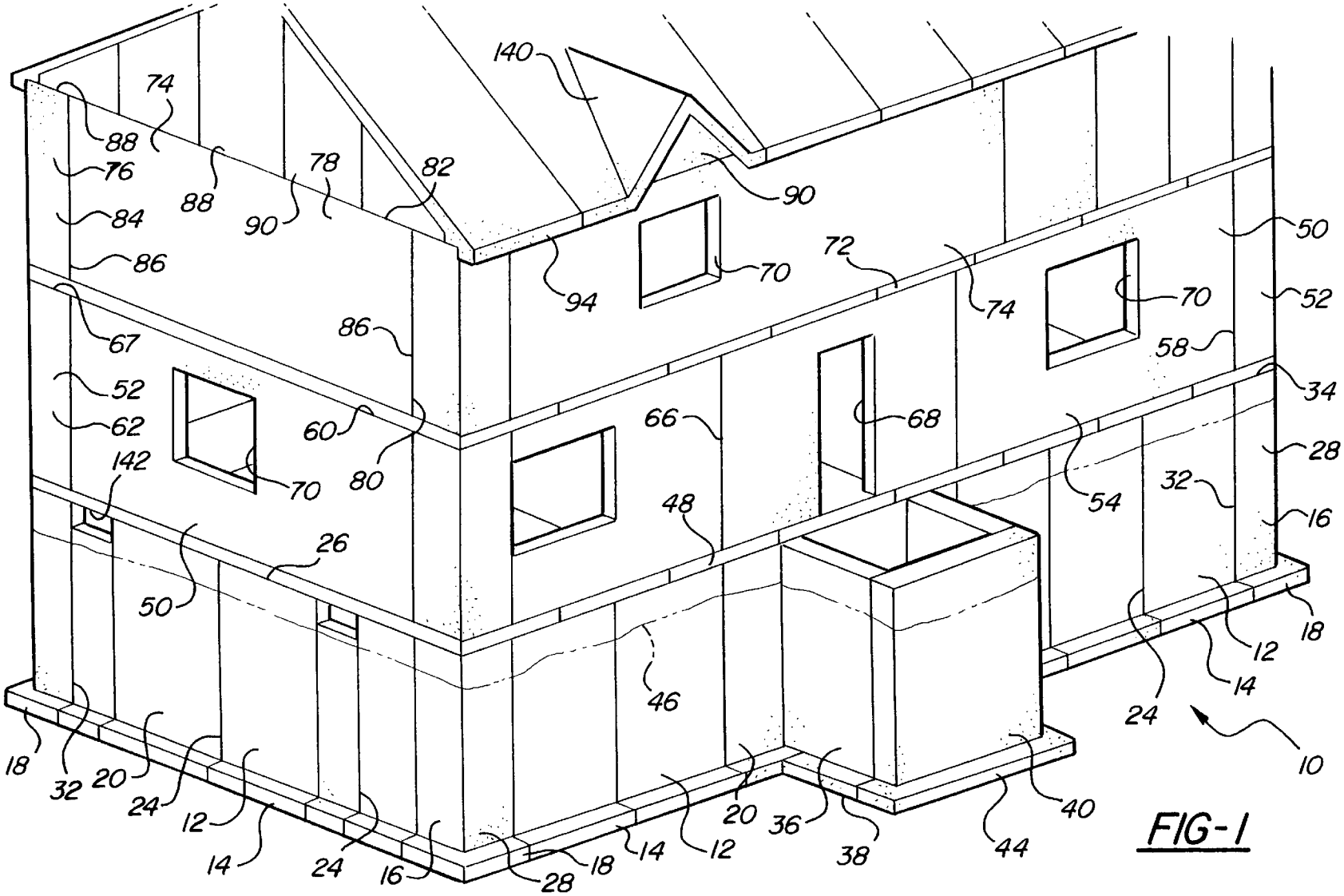
FIG. 1 is a perspective view of a house made from precast members.

The house 10 shown in FIG. 1 includes a lower level made from precast lower level elongated wall sections 12 with integral footings 14 and precast lower level corner sections 16 with integral footings 18. The wall sections 12 have outside surfaces 20, inside surfaces 22, end surfaces 24 and top surfaces 26. The corner sections 16 also have outside surfaces 28, inside surfaces 30, end surfaces 32 and top surfaces 34.

An appropriate excavation is made for the house 10 and flat surfaces for the integral footings 14 and 18 are provided. The flat footing support surfaces are preferably compacted and may be covered with a compacted aggregate. The corner sections 16 and the wall sections 12 are positioned on the flat support surfaces with their end surfaces 24 and 32 abutting or adjacent to the end surfaces on adjacent corner sections 16 or wall sections 12. Special porch foundation sidewalls 36 with integral footings 38 and a porch foundation front wall 40 with an integral footing 44 are positioned adjacent to the outside surface 20 of wall section 12. The footings 38 of sidewalls 36 and front wall 40 accommodate the footings 14 of the adjacent wall section 12 and do not require corner sections. If there is to be a basement, precast concrete basement floor slabs 42 are set on top of the footings 14 and 18 inside the wall surfaces 22 and 30 of the wall sections 12 and the corner sections 16. If there is not to be a basement, the area surrounded by the wall sections 12 and corner sections 16 can be filled with soil, aggregate, or other appropriate material. Fill is placed against the outside surfaces 20 and 28 of the wall sections 12 and corner sections 16 to a desired ground level 46. First level floor slabs 48 are placed on top of the top surfaces 26 and 34 of the lower level wall sections 12 and the lower level corner section 16. First level precast elongated wall sections 50 and corner sections 52 are positioned on top of the floor slabs 48. The wall sections 50 have outside surfaces 54, inside surfaces 56, end surfaces 58 and top surfaces 60. The corner sections 52 have outside surfaces 62, inside surfaces 64, end surfaces 66 and top surfaces 67. The first level wall sections 50 and corner sections 52 are positioned on the first level floor slabs 48 with their end surfaces 58 and 66 abutting the end surfaces on adjacent corner and wall sections. Appropriate door openings 68 and window openings 70 are provided in the wall sections 50.

An upper level is provided by placing upper level floor slabs 72, that are identical to the first level floor slabs 48, on top of the top surfaces 60 and 67 of the wall sections 50 and corner sections 52. Upper level precast elongated wall sections 74 and upper level corner sections 76 are positioned on the upper level floor slabs 72. The upper level wall sections 74 and corner sections 76 are identical to the first level wall sections 50 and corner sections 52. The upper level wall sections 74 have outside surfaces 78, end surfaces 80 and top surfaces 82. The upper level corner sections 76 have outside surfaces 84, end surfaces 86 and top surfaces 88.

Precast gable sections 90 are positioned on top of the top surfaces 82 and 88 of the upper level wall sections 74 and corner sections 76. Each gable section 90 can be a single piece or multiple pieces like the wall sections 74. A ridge beam 92 is placed on top of the gable sections 90. Roof slabs 94 are then placed on top of the upper surface 93 of the ridge beam 92 and the top surface 82 of the wall sections 74 and the top surface 88 of the corner sections 76. A tongue 96 and a groove 98 are provided at the joint between adjacent roof slabs 94. A sealant 100 is provided to prevent roof leaks through the joints between adjacent roof slabs 94.

Figure 7:
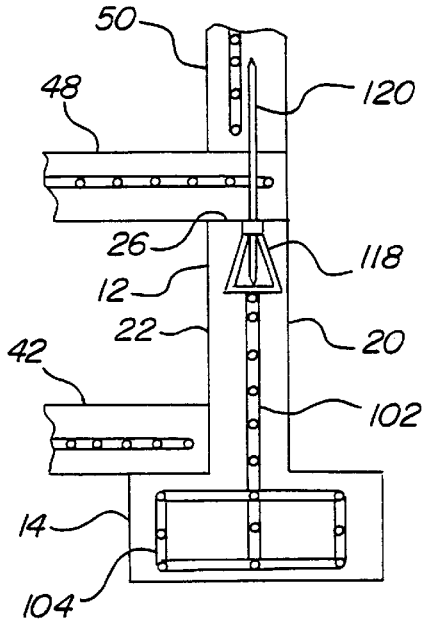
FIG. 7 is an end elevational view of a portion of a lower level elongated wall section with an integral footing, a basement floor slab, a first level floor slab and an upper level wall section with parts broken away.

The corner sections 16, 52, and 76, the wall sections 12, 50, and 74, and the gable sections 90 are all precast concrete with a steel mesh reinforcement 102. The footings 14, 18, 38, and 44 have additional steel mesh reinforcement 104, as shown in FIG. 7, which is preferably connected to the steel mesh reinforcement 102. The sidewalls 36, front wall 40, floor slabs 42, 48, and 72, the ridge beam 92 and the roof slabs 94 also have a steel mesh reinforcement 106.

The end surfaces 24, 32, 58, 66, 80, and 86 of the corner sections 16, 52, and 76 and the wall sections 12, 50, and 74 have vertically extending channel members 108 welded to the steel mesh reinforcement 102. The channel members 108 have an open side that is in the same plane as the end surfaces 24, 32 58, 66, 80, and 86 of the wall sections 12, 50, and 74 and the corner sections 16, 52, and 76. The channel members 108 are substantially fully embedded within the concrete material that encases the steel mesh reinforcement 102. The channel members 108 and the integral steel mesh reinforcement 102 control the length of the wall and corner sections 12, 50 and 74 and 16, 52 and 76. The length of the corner and wall sections must be accurately controlled to control building dimensions and provide proper alignment of building components. The channel members 108 preferably have sidewalls 110 and 112 that extend from a base 114 toward a common point of convergence. With this shape, the channel members 108 form a mortise, as shown in FIGS. 2 and 6. The male connecting bar 116, with a double dove-tail shape, when inserted into two adjacent channel members 108 will hold the corner sections 16, 52, and 76 and the wall sections 12, 50, and 74 in a vertical position and will also prevent horizontal separation. This arrangement of the channel members 108 and bar 116 forms a rigid joint that can transmit tension, shear, bending, and compression forces from the steel reinforcement mesh 102 of one wall section 12, 50, or 74 to the steel mesh reinforcement 102 of another wall section or corner section 16, 52, or 76.

Flared coil loops 118 are embedded in the upper portion of each elongated wall section 12, 50, and 74 adjacent to the top surface 26, 60, or 82. The flared coil loops 118 can be welded to the reinforcement 102. A sheebolt 120 is secured to each flared coil loop 118 with its free end extending vertically up from the top surface 26, 60, or 82. The sheebolts 120 can be attached to the flared coil loops 118 by a threaded end 121 that screws into a threaded socket 123 of each flared coil loop. Sheebolts 120 extend upwardly into passages through floor slabs 48 and into apertures in the bottom of elongated wall sections 50 and 74, as shown in FIG. 7. The passages which receive the sheebolts 120 can be formed by a pipe encased in the concrete. A pipe with internal threads can also be used in place of the flared coil loops 118. The pipes are preferably welded to the steel mesh reinforcement 102. The sheebolts 120, which pass through the floor slabs 48, have sufficient length to extend into the precast elongated wall sections 50 that sit on top of the floor slabs. The purpose of the vertical sheebolts 120 is to maintain alignment and prevent horizontal movement between wall sections 12, 50, and 74 and floor slabs 48 and 72. Flared coil loops 118, sheebolts 120, and passages for receiving the sheebolts 120 could also be employed with the corner sections 16, 52, and 76, if desired. The gable sections 90 set directly on top of the surfaces 82 of the wall sections 76 below the gable sections. The sheebolts 120 extend vertically from the wall sections 74 into passages in the gable sections 90. The purpose of these sheebolts 120 is to prevent horizontal movement of the gable sections 90 relative to the wall sections 74 that support them.

The ridge beam 92 is supported by the upper surface of gable sections 90. Roof slabs 94 include horizontal surfaces 130 that set on the upper surface 93 of the ridge beam 92. The roof slabs 94 also have a lower horizontal surface 136 that sits on the top surface 82 of the upper wall sections 76. Pins 138 extend vertically from the ridge beam 92 and the upper wall sections and roof slabs 94. If desired, the pins 138 can be anchored to the ridge beam 92 and to the upper wall sections 76 by flared coil loops 118. The upper ends of the pins 138 can be threaded and nuts 139 can be employed to clamp the roof slabs 94 in place. Filler members 141 cover the nuts 139 and eliminate leaks. The gable sections 90 also, have embedded flared coil loops 118 in their upper surfaces. Sheebolts 120 are secured to the flared coil loops 118 and extend vertically upward into passages in the roof slabs 94. If these passages in the roof slabs 94 extend through the roof slabs, nuts 139 can be used to clamp the roof slabs to the gables 90 and the nuts can be covered by a filler member 141.

Dormers 140 can be formed in the roof slabs 94, as shown in FIG. 1, if desired. The dormers 140 are preferably preformed separately and attached to the roof slabs 94 later. The dormers 140 could also be formed as an integral part of the roof slabs 94.

The sealant 100 is provided between adjacent roof slabs 94, as mentioned above. A similar sealant can be employed to seal joints between corner sections 16, 52, and 76, elongated wall sections 12, 50, and 74, floor slabs 42, 48, and 72, and gables 90, if desired.

The roof slabs 94 can have a textured upper surface with a shape and appearance of roof tile, shingles, or other roofing materials. The outside surfaces 20, 28, 54, 62, 78, and 84 of the corner sections 16, 52, and 76, the elongated wall sections 12, 50, and 74, and the gable sections 90 can be provided with embedded rocks, cut stone, bricks, molded brick shapes, stucco, or other masonry surfaces. These outside surfaces could also be shaped like wood lapped siding, or some other decorative surface.

The elongated wall sections 12, 50, and 74 have a height that is sufficient to provide space for a floor covering, a ceiling, space for utilities and the desired floor to ceiling space. It is expected that for most construction a height of between 8' and 12' would be satisfactory. The length of the elongated wall sections can vary, as required, as long as they can be transported to a construction site. Elongated wall sections 12, 50, and 74 with lengths of 50' or so can easily be transported over good roads. The crane that places the elongated wall sections 12, 50, and 74 and floor slabs 42, 48, and 72 in position will have to have sufficient capacity to lift the elongated wall sections and floor slabs. Cranes are readily available that can lift and position loads in excess of ten tons. The corner sections 16, 52, and 76 are sized to correspond with the elongated wall sections 12, 50, and 74.

The lower level elongated wall sections 12 and corner sections 16 include integral footings 14 and 18. To accommodate the footings 16 and 18, it may be necessary to increase the overall height. If the overall height exceeds about 12', it may be necessary to employ lower level elongated wall sections with a length of about 12' to permit transport to a construction site at a reasonable cost.

The gable sections 90 may be precast in one piece or they may include multiple pieces. If the gable sections 90 have multiple pieces, the vertical joints should have connectors like the connectors employed to connect the ends of wall sections 12, 50, and 74 to the ends of corner sections 16, 52, and 76. Horizontal joints in gable sections 90 would have sheebolts 120 on one gable section that extends into passages in an adjacent gable section.

The end connector with channel members 108 and a connecting bar 116 is one of several end connectors that can be employed. The end connector used depends on a number of factors including cost, strength, rigidity, ease of erection, versatility and choice. One alternate connection between an end 32, 58 and 86 of a corner section 16, 52, or 76 and an end surface 24, 66 and 80 of a wall section 12, 50, or 74, or between the ends of two wall sections is shown in FIG. 9. The construction includes a channel member 108 embedded within the concrete material of a wall section 12, 50, or 74 and welded to the steel mesh reinforcement 102. A male connecting bar 160 with a single dove-tail shape is welded to the steel mesh reinforcement 102 in an adjacent corner section 16, 52, or 76 or another wall section 12, 50 or 74. The single dove-tail extends out of one end surface 32, 58 or 86 of the corner section 16, 52, or 76 or the end surface 24, 66 or 80 of another wall section 12, 50 or 74 and is held in the channel member 108 of the adjacent wall section 12, 50, or 74. This connection provides excellent strength and permits only minimal movement between wall sections 12, 50, and 74 and corner sections 16, 52, and 76. The single dove-tail of the connecting bar 160 is inserted into a channel 108 as either a wall section 12, 50, or 74, or a corner section 16, 52, or 76 is lowered into position by a crane. This connector 108 and 160, because of its high strength in tension, compression, shear, bending and torque is preferred in areas with earthquakes and unstable soils. It is also the preferred connection for wall sections 12 and corner section 16 with integral footings 14 and 18 used as retaining walls, sea walls, flood control dikes and other similar uses.

Another alternate connection between the ends 32, 58 or 86 of a corner section 16, 52, or 76 and a wall section 12, 50, or 74, or between the two wall sections is shown in FIG. 10. The connection includes one or more bars 166 that form an open bight 168 with the ends welded to the steel mesh reinforcement 102 on one end surface 172 of a wall section 173. A recess 170 is provided in the end surface 172 of the wall section 173 as shown in FIG. 10. The recess 170 extends vertically in the end surface 172. One or more bars 174 that form an open bight 176, with the ends welded to the steel mesh reinforcement 102, extend from the end 178 of a wall section 179. A vertically extending recess 180 is provided in the end 178 of the wall section 179. Portions of the bar 174 that form an open bight 176 are inserted into the recess 170 in the wall section 173 and, at the same time, portions of the bar 166 that form an open bight 168 are inserted into the recess 180 in the end 178 of the wall section 179 during erection of the wall sections. A connector rod 182 is then inserted vertically into the passage formed by adjacent open bights 168 and 176 to secure the wall sections 173 and 179 to each other. The joint between the ends 172 and 178 of adjacent wall sections is sealed by a seal 184. This connection is relatively quick and easy to make but is less rigid than the end connectors described above. During erection of wall sections 173 and 179, the last wall section to be positioned is first lowered to a position above the sheebolts 120. The last wall section 173 or 179 to be positioned is then moved horizontally and portions of the bars 174 that form the open bights 176 enter the recess 170 and portions of the bars 166 that form the open bights 168 enter the recess 180. The last wall section 173 or 179 to be positioned is then lowered and the sheebolts 120 enter the passages in the bottom of the wall section. It is desirable for the sheebolts 120 to project eighteen inches or more into passages in the bottom of a wall section 173 or 179. The bars 166 and 174 must be spaced apart and positioned to accommodate the required vertical movement. A corner section 16, 52, or 76 is positioned last when employing connectors with bars 166 and 174.

Figure 11:
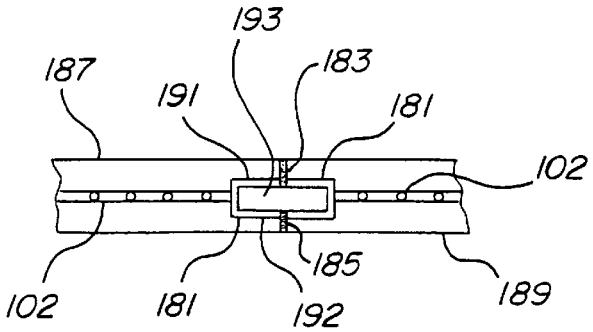
FIG. 11 is a plan view of another alternate connection between adjacent ends of elongated wall sections.

A further end connector is shown in FIG. 11. The connector includes channel members 181 embedded in the ends 183 and 185 of wall sections 187 and 189. The channel members 181 are welded to the steel mesh reinforcement 102. The walls 191 and 192 of the channel members 181 are parallel to each other. When the ends 183 and 185 of wall sections 187 and 189 are adjacent to each other, the channel members 181 cooperate to form a rectangular passage. A rectangular bar 193 is inserted into the channel members 181 to hold the wall sections 187 and 189 in alignment with each other. The end connector is relatively inexpensive and easy to install. The rectangular bar 193 will allow a wall section 187 to be moved horizontally into engagement with the rectangular bar and a wall section 189. However, the rectangular bar 193 will not transmit tension forces.

The footings 14 and 18 can be expected to settle some even when the footings have a large width and therefore a large area, the soil is stable and the soil has been compacted before the lower level wall sections 12 and corner sections 16 with integral footings are placed in position on the soil. Slight settling of one corner section 16 or wall section 12 will reduce the load upon the section that settles and increases the load on adjacent wall and corner sections that settled less. The increased load will tend to cause the more heavily loaded wall and corner sections 12 and 16 to settle thereby keeping the corner sections and the wall sections in horizontal alignment with each other. A building constructed with precast wall sections 12, 50, and 74 and corner sections 16, 52, and 76 on unstable soil could experience substantial settling in one or more areas. The end connectors described above will all permit at least some vertical movement between adjacent wall sections 12, 50, and 74 and corner sections 16, 52, and 76. Significant vertical movement between a wall section 12 and a corner section 16 or between two corner sections could affect the structured integrity of a building 10. It is therefore desirable to lock adjacent ends of lower level wall sections 12 and corner sections 16 together in such a way as to prevent vertical movement of one section relative to an adjacent section. Preventing vertical movement between the lower level wall sections 12 and corner sections 16 with their integral footings 14 and 18 will protect the wall sections and corner sections, supported by the footings and their integral wall sections and corner sections. Vertical movement between adjacent footings 14 and 18 can be substantially eliminated by welding a horizontal channel member, like the vertical channel members 108 to the steel mesh reinforcement 104 in the footings with the open portion of the channel in the same planes as the end surfaces 24 and 32 of the lower level wall sections 12 and corner sections 16. After adjacent wall and corner sections 12 and 16 are in place, a double dove tail male connecting bar like the connecting bar 116 can be telescopically inserted horizontally into the two adjacent channels. The horizontal double dove tail male connecting bar will prevent vertical movement between two adjacent sections while the connectors described above will prevent both lateral and longitudinal horizontal separation. Most loads on the wall sections 12, 50, and 74 and corner sections 16, 52, and 74 will result in tension loads on their entire steel mesh reinforcement 102 and 104. There will also be bending, torsion and shear loads exerted on the steel mesh reinforcement. Compression loads are, for the most part, resisted by the concrete in with the steel mesh reinforcement 102 and 104 is embedded. The bending, torsion and shear loads, like the tension loads, are transmitted throughout the entire structure by the steel mesh reinforcement 102 and 104, by the end connectors and by the sheebolts. The end result is a building with superior strength to withstand the forces of nature.

Figure 12:
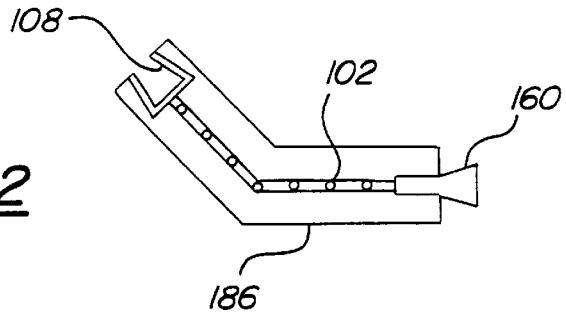
FIG. 12 is a plan view of a 45° corner section.
Figure 8:
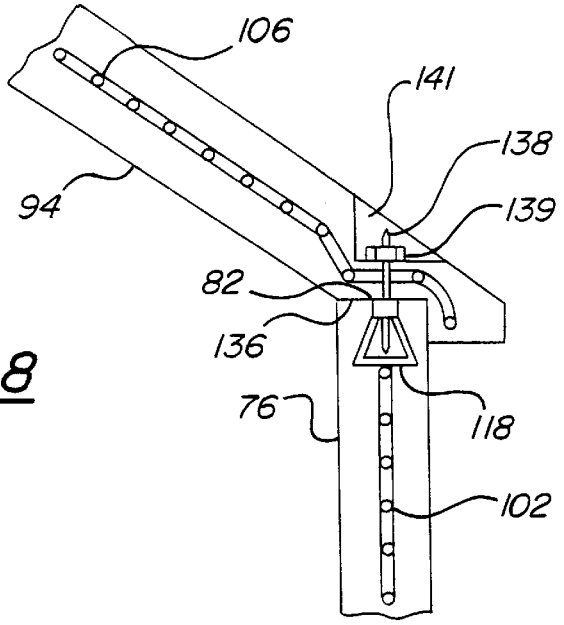
FIG. 8 is an elevational view with parts broken away to show the connection between roof slabs and wall sections.
Figure 13:
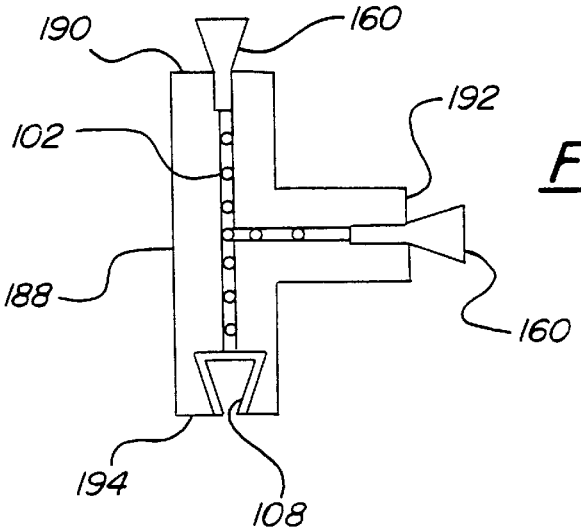
FIG. 13 is a plan view of a corner section with three ends for connection to three wall sections.
Figure 14:
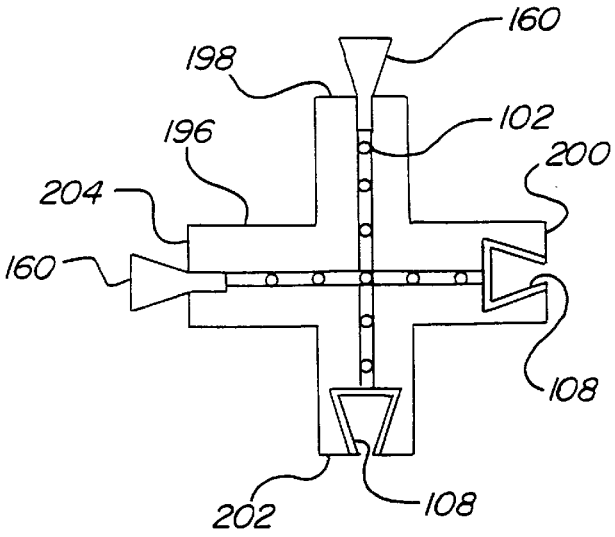
FIG. 14 is a plan view of a corner section with four ends for connection to four wall sections.

The corner sections 16, 52, and 76 described above are right angle sections with two ends 32, 58 or 86 that connect to adjacent wall sections 12, 50, or 74, or to another corner section. For more complex structures, the corner sections could have ends that connect to wall sections 12, 50, or 74 that extend at an angle other than 90° relative to each other like the corner section 186 shown in FIG. 12. Corner sections 188 with three ends 190, 192, and 194, as shown in FIG. 13, could be employed. Corner sections 196 with four ends 198, 200, 202 and 204, as shown in FIG. 14, are used in some buildings 10. Special corner sections or connectors with different numbers of end surfaces and a variety of shapes can be employed to construct structures with unusual geometric shapes.

The wall sections 12, 50, and 74, and the corner sections 16, 52 and 76 can be precast with a layer of insulation material such as a foam board embedded within the concrete. The foam board substantially reduces the rate of heat transfer through the walls but provides little strength. It would be necessary to connect the concrete on both sides of a foam board in some areas to form a stable structure.

Color can be added to concrete during the mixing process if desired. Coatings that prevent the absorption of water can be applied to precast concrete sections in the factory prior to the sections being transported to a construction site for erection. Paint can also be applied in the factory or in the field after erection.

Figure 15:
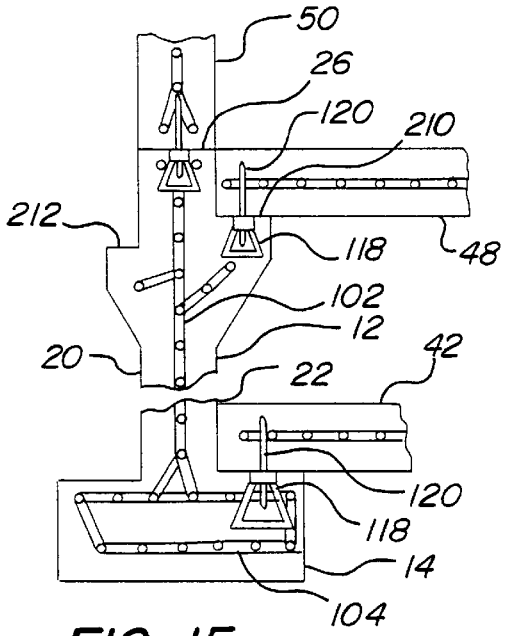
FIG. 15 is an end elevational view of a portion of a lower level elongated wall section with an integral footing, a basement floor slab, a first level floor slab supported on a ledge integral with lower level upper wall and corner sections and an upper level wall section with parts broken away.

FIG. 15 is a view similar to FIG. 7 showing an alternate construction for supporting floor slabs 48. In this alternate construction, an integral ledge 210 is formed, on the inside surface 22 of the lower wall sections 12 and the inside surface 30 of the lower level corner sections 16 during precasting. The steel mesh reinforcement 102 extends into the integral ledge 210. Flared coil loops 118 are embedded in the integral ledge 210. Sheebolts 120 are attached to the coil loops 118 and extend vertically upward from the integral ledge 210. Passages in the first level floor slabs 48 receive the sheebolts 120 when the first level floor slabs 48 are lowered onto the integral ledge 210. The first level wall sections 50 and corner sections 52 are positioned directly on the top surface 26 and the top surface 34 of the lower level elongated wall sections 12 and corner sections 16, as shown in FIG. 3. With this construction, the floor slabs 48 are the same length as the basement floor slabs 42, and the walls 12, 50, and 74 have fewer joints to be sealed. An integral ledge 212 can also be formed on the outside surfaces 20 and 28 of the wall sections 12 and corner sections 16 to support brick or stone veneer.

Architects frequently design buildings with upper floors that have a larger area than lower floors. The area is increased by creating a cantilever that supports one or more walls laterally spaced outwardly from the lower supporting walls. An integral ledge 212 can be provided on the upper portion of first level elongated wall sections 50 and corner sections 52. The integral ledge 212 extends outwardly from the outside surface 54 and the outside surface 62 of the wall section 50 and the corner section 52. The upper level wall sections 74 and corner sections 76 are mounted on the integral ledge 212 and held in place by sheebolts 120 the same way they are attached to the top of a first level wall section 50 and corner section 52. The integral ledge 212 can be provided on all wall and corner sections 50 and 52 or only in selected areas. The integral ledges 212 can be provided to support the first level wall and corner sections 50 and 52 as well as upper level wall and corner sections 74 and 76. The length of elongated wall sections 50 and 74 and/or corner sections 52 and 76 is increased as required to accommodate the larger floor area.

The building 10 is constructed employing the reinforced precast concrete members described above by first preparing a building site. An excavation is made and a flat surface is prepared and compacted if necessary. An aggregate cover material can be provided on the flat, compacted surface, if desired. The lower level elongated wall sections 12 and corner sections 16 with integral footings 14 and 18 are transported to the site and placed in position on the flat surface. Double dove-tail male connecting bars 116 or similar members are positioned in the channel members 108 to lock adjacent wall sections 112 and corner sections 16 to each other. The male connecting bars should hold the outside surfaces 20 and 28 and inside surfaces 22 and 30 in vertical planes. The male connecting bars 116 with a double dove-tail shape will also prevent separation of adjacent elongated wall sections 12 and corner sections 16. When constructing a building on a building site with unstable soil or in an area that has earthquakes, the male connecting bars 116 should extend from the upper surfaces 26 of the wall sections 12 to the bottom of the footings 14. On a building site with stable soils and in an area that has, at the most, infrequent mild earthquakes, a short section of male connecting bar 116 in the bottom portion of the channel members 108 and a short section of a male connecting bar 116 near the top of channel members 108 would be sufficient to hold the wall sections and the corner sections in position. The area adjacent to the outer surface 20 of the lower level wall sections 12 and the corner sections 16 can then be filled with soil up to the level 46. Basement floor slabs 42 can be placed on top of the footings 14, as shown in FIG. 7 or, if weather permits, a concrete floor can be poured in place. If precast floor slabs are used, the work can proceed in cold weather.

The lower level corner sections 16 and wall sections 12 form a foundation for a building. If desired, a frame building or a conventional masonry structure can be built on top of the foundation.

First level floor slabs 48 are placed on top of the wall sections 12 and the corner sections 16, if the building 10 is to continue with the precast concrete construction. First level wall sections 50 and corner sections 52 are then placed on top of the first level floor slabs 48. The sheebolts 120 described above extend upwardly through the floor slabs 48 and into the first level wall sections 50, to horizontally fix the first level wall sections and floor sections relative to the lower level wall sections 12 and corner sections 16. Male connecting bars 116 are inserted into the channel members 108 to lock the corner sections 52 and the wall sections 50 together. If the building is to have a first level only, precast roof slabs 94 can be placed on top of the first level wall and corner sections 50 and 52. If desired, a conventional roof made from lumber and shingles could be erected on the first level wall and corner sections 50 and 52. The precast roof slabs 94 are preferred in areas in which the building 10 can be subjected to strong winds, fire storms, tornados, hurricanes and other violent weather conditions. An upper level can be constructed in the same way that the first level was constructed, if the building is to include an upper level. A roof can be constructed above the upper level, as explained above, or an additional upper level can be added.

The provision of channel members 108 at both ends of the wall sections 12, 50, and 74, and corner sections 16, 52, and 76 allow wall sections and corner sections to be turned from end to end and simplify placement of the wall sections 12, 50, and 74 and corner sections 16, 52, and 76 at a construction site. However, the male connecting bar 160 can be welded to the steel mesh reinforcement 102 and a channel member 108 can be eliminated. With this construction, an exposed portion of a connecting bar 160 is telescopically received in a channel member 108, as a wall section 12, 50, or 74, or a corner section 16, 52, or 76 is lowered into position by a crane. Aligning a connecting bar 160, that is integral with a wall section 12, 50, or 74 that may weight several tons, with a channel member 108, and moving them into telescopic engagement without damage requires skilled personnel. These erection procedures are modified as required to accommodate the end connectors described above.

After the roof slabs 94 are in place, windows can be installed in the window openings 142 and 70. Interior wall coverings, ceilings and floor coverings are installed. Insulation is provided where required. Doors are installed in the door openings 68. Precast interior walls can be constructed in the same way as the exterior is constructed. However, interior partitions constructed by common building techniques will normally be used. A precast concrete slab (not shown) is placed on the sidewalls 36 and the front wall 40 to complete the porch.

While preferred embodiments of the invention have been shown and described, other embodiments will now become apparent to those skilled in the art. Accordingly, the invention is not limited to that which is shown and described, but by the following claims:

What is claimed is:

1. A building comprising: a foundation having a steel mesh reinforcement and a plurality of metal connectors welded to the steel mesh reinforcement; a plurality of precast floor slabs; supported by the foundation; a plurality of precast first level corner sections supported by the plurality of precast floor slabs and the foundation and each including a steel mesh reinforcement encased in concrete, a first end surface and a second end surface; a plurality of first level elongated wall sections supported by the plurality of precast floor slabs and the foundation and including a steel mesh reinforcement encased in concrete, window openings through at least some of the wall sections, door openings through at least some of the wall sections, a first end surface on each wall section and a second end surface on each wall section; a metal connector assembly for holding each of the first end surfaces in a substantially fixed position relative to the second end surface on an adjacent section; a plurality of vertical sheebolts extending downward into the metal connectors in the foundation, extending upward through the plurality of precast floor slabs and extending upward into the plurality of first level elongated wall sections.

2. A building as set forth in claim 1 wherein the metal connector assembly includes a channel member welded to the steel mesh reinforcement adjacent to the first end surface of one section; and a bar welded to the steel mesh reinforcement adjacent to the second end surface of another section and telescopically received in the channel member.

3. A building as set forth in claim 2 wherein the portion of the bar that is telescopically received in the channel has a dove tail shape and the channel member has a corresponding shape that substantially limits the bar to vertical movement relative to the channel.

4. A building as set forth in claim 1 wherein the metal connector assembly includes a channel member welded to the steel mesh reinforcement adjacent to the first end surface of one section; a channel member welded to the steel mesh reinforcement adjacent to the second end surface of another section; and a bar member telescopically received in both channel members.

5. A building as set forth in claim 4 wherein the bar member has a double dove tail cross section shape, both channel members have a shape corresponding to one of the dove tails and the channel members substantially limit the bar member with a double dove tail shape to vertical movement relative to the channels.

6. A building as set forth in claim 1 wherein the metal connector assembly includes a plurality of rods each of which have an open bight that extends horizontally from the first end surface of one section and that is welded to the steel mesh reinforcement adjacent to the first end surface; a plurality of rods each of which have an open bight that extends horizontally from the second end surface of another section and are welded to the steel mesh reinforcement adjacent to the second end surface and are vertically spaced from the rods that extend horizontally from the end surface of said one section; and a vertical bar that extends through the open bight of the rods that extend horizontally from said first end surface and from second end surface.

7. A building as set forth in claim 1 including a plurality of corner section retainers connecting the first level corner sections to the foundation.

8. A building as set forth in claim 1 including a plurality of wall section retainers connecting the first level elongated wall sections to the foundation.

9. A building as set forth in claim 8 including a plurality of corner section retainers connecting the first level corner sections to the foundation.

10. A building as set forth in claim 1 including a plurality of vertical corner sheebolts each of which extends downward into the foundation, extends upward through one of the plurality of precast floor slabs and extends upward into one of the plurality of precast first level corner sections.

11. A building comprising a foundation; a plurality of precast first level corner sections supported by the foundation and each including a steel mesh reinforcement encased in concrete, a first end surface and a second end surface; a plurality of first level elongated wall sections supported by the foundation and including a steel mesh reinforcement encased in concrete, window openings through at relative to a second end surface on an adjacent section; and vertical rods that extend vertically downward into the foundation and vertically upward into the first level elongated wall sections.

12. A building as set forth in claim 1 including a ridge beam supported by the gable sections and a plurality of precast roof slabs with steel mesh reinforcement encased in concrete, supported by the ridge beam, and by the first level elongated wall sections.

* * * * *

UNITED STATES PATENT AND TRADEMARK OFFICE

CERTIFICATE OF CORRECTION

PATENT NO. : 6,076,319
DATED : June 20, 2000
INVENTOR(S) : Gary L. Hendershot et al It is certified that error appears in the above-identified patent and that said Letters Patent is hereby corrected as shown below:

Column 1,
Line 11, change "OP" to -- OF --.

Rewrite claim 11, as follows:

11. A building comprising a foundation; a plurality of precast first level corner sections supported by the foundation and each including a steel mesh reinforcement encased in concrete, a first end surface and a second end surface; a plurality of first level elongated wall sections supported by the foundation and including a steel mesh reinforcement encased in concrete, window openings through at least some of the wall sections, a first end surface on each wall section and a second end surface on each wall section; a metal connector assembly for holding each of the first end surfaces in a substantially fixed position relative to a second end surface on an adjacent section; a plurality of vertical rods that extend vertically upward into the first level elongated wall sections; at least two precast concrete gable sections supported by two or more of the first level elongated wall sections; and vertical rod that extend vertically downward into the first level elongated wall sections and vertically upward into the gable sections.

Signed and Sealed this

Seventh Day of August, 2001

Nicholas P. Godici

*Attest:*

*Attesting Officer*

NICHOLAS P. GODICI
*Acting Director of the United States Patent and Trademark Office*